US006467741B1

(12) United States Patent
Shih

(10) Patent No.: US 6,467,741 B1
(45) Date of Patent: Oct. 22, 2002

(54) STEEL PROP CAPABLE OF BEARING BIDIRECTIONAL APPLIED FORCE

(76) Inventor: Lung Ching Shih, No. 64, Chung Tai Road, Taichung (TW)

( * ) Notice: Subject to any disclaimer, the term of this patent is extended or adjusted under 35 U.S.C. 154(b) by 0 days.

(21) Appl. No.: 09/820,772

(22) Filed: Mar. 30, 2001

(51) Int. Cl.[7] ..... E04G 25/00
(52) U.S. Cl. ..... 248/200.1; 248/354.4
(58) Field of Search ..... 248/200.1, 265, 248/297.31, 288.51, 406.1, 296.1, 422, 157, 423, 354.4, 351; 411/265, 433, 436, 246

(56) References Cited

U.S. PATENT DOCUMENTS

| | | | | | |
|---|---|---|---|---|---|
| 2,462,662 | A | * | 2/1949 | Niceley | 248/351 |
| 2,556,357 | A | * | 6/1951 | Baldwin | 255/53 |
| 3,059,888 | A | * | 10/1962 | Lie | 248/161 |
| 4,111,217 | A | * | 9/1978 | Victor | 135/15 PQ |
| 4,221,363 | A | * | 9/1980 | Jasper | 254/98 |
| 4,655,426 | A | * | 4/1987 | von Dulong et al. | 248/405 |
| 5,056,753 | A | * | 10/1991 | Lunau et al. | 248/542 |
| 5,116,004 | A | * | 5/1992 | Luecke | 248/161 |
| 5,387,239 | A | * | 2/1995 | Bianco et al. | 623/18 |
| 5,826,847 | A | * | 10/1998 | Warner et al. | 248/354.1 |
| 5,836,555 | A | * | 11/1998 | Ellsworth et al. | 248/161 |

* cited by examiner

*Primary Examiner*—Leslie A. Braun
*Assistant Examiner*—A. Joseph Wujciak, III
(74) *Attorney, Agent, or Firm*—Browdy and Neimark, P.L.L.C.

(57) ABSTRACT

Steel prop capable of bearing bidirectional applied force, including: an outer tube; an inner tube having a bottom end slidably nested in the outer tube; two clamping members, an inner circumferential face of each clamping member being formed with several transverse thread sections, a pressed section being formed on outer circumferential face of the clamping member, two lateral sides of the clamping members being such connected that they can be moved toward or away from each other within a certain distance without departure; and a retaining member. Inner circumference of the retaining member is formed with two inward projecting engaging lips at equal intervals. A bottom face of the engaging lip is formed with a pressing face. The retaining member is rotatably fitted around top end of the outer tube without departing therefrom. The bottom ends of the clamping members are positioned on the conic face of top end of the outer tube. The pressed sections are positioned under the engaging lips of the retaining member. When rotating the retaining member in one direction, the pressing faces of the engaging lips press the pressed sections of the clamping members to make the clamping members tightly clamp the inner tube. When rotating the retaining member in the other direction, the inner tube is released from the clamping of the clamping members.

8 Claims, 16 Drawing Sheets

STEEL PROP CAPABLE OF BEARING BIDIRECTIONAL APPLIED FORCE

BACKGROUND OF THE INVENTION

1. Technical Field of the Invention

The present invention is related to a steel prop for supporting moldboards, and more particularly to a steel prop which is able to bear axial bidirectional applied force.

2. Prior Art

FIG. 1 shows a conventional steel prop 10 for supporting mold board. The steel prop 10 includes: an outer tube 12; an adjustment seat 13 fixedly connected with top end of the outer tube; a retaining nut 15 screwed around the adjustment seat 13 for adjusting height of the prop; an inner tube 16 formed with several pin hole 17 at equal intervals, the inner tube 16 being nested in the outer tube 12 and the adjustment seat 13; and an insertion pin 18 transversely passed through a slot 14 of the adjustment seat 13 and inserted in any of the pin holes 17 of the inner tube 16. In use, the inner and outer tubes 16, 12 are adjusted to a desired length. Then, the insertion pin 18 is inserted through the slot 14 of the adjustment seat 13 into one of the pin holes 17 of the inner tube 16. Then, the retaining nut 15 is screwed as shown by phantom line of FIG. 2 to retain the insertion pin 18. Accordingly, the extending length of the inner and outer tubes 16, 12 can be adjusted for supporting moldboards.

The above steel prop 10 has many imperfections. For example, when adjusting the length, it is time-consuming and inconvenient to operate the prop 10. Moreover, the insertion pin 18 contacts with the periphery of the pin hole 17 only at a point with small contacting area. Therefore, a shear stress is likely to be applied to the prop and the strength of the prop is poor.

In order to solve the above problems, an improved steel prop 20 has been developed as shown in FIG. 3. Such prop 2 includes an outer tube 22, an inner tube 24, two engaging members 25 and a locking member 28. The top end of the outer tube is formed with a conic face 23. The body of the inner tube 24 is formed with a thread and nested in the outer tube 22. The inner circumference of each engaging member 25 is formed with transverse thread section 26. The two engaging members 25 are positioned on the conic face 23 of the outer tube 22 and connected by a pin member 27 on one side. The locking member 28 is disposed on the other side of the engaging members 25.

In use, as shown in FIG. 5, when the wedge locking bar 29 of the locking member 28 is positioned at an upper dead end, the two engaging members 25 are not mated with each other so that they do not mesh with the inner tube 24. At this time, the inner tube 24 is upward pulled out as shown in FIG. 6. After pulled to a certain length, a user can downward knock the locking bar 29 with a tool as shown in FIG. 7. Accordingly, the two engaging members 25 are mated with each other and the thread sections 26 thereof mesh with the thread of the inner tube 24 as shown in FIG. 8. Under such circumstance, the inner tube 24 is prevented from retracting into the outer tube 22. Accordingly, the prop can be used to support moldboards.

Such steel prop 20 can be more quickly adjusted in length so that the time for adjustment is saved. In addition, the thread sections 26 of the engaging members contact with the inner tube on a face so that the inner tube is firmly clamped to provide higher supporting strength.

However, it is found that the above steel prop 20 still has shortcomings. For example, the steel prop can only bear axial pressure, while failing to bear axial tension. In other words, in locked state, the inner tube of such steel prop is prevented from retracting into the outer tube. However, the inner tube is not prevented from moving out of the outer tube. Therefore, when subject to a pulling force and pulled outward, the inner tube will slide within the outer tube. Accordingly, the steel prop can be only used in an upright state to resist against axial pressure, while failing to bear axial pulling force. Therefore, such prop can be hardly used in an oblique state or a horizontal state to support moldboards. As a result, the application field of such prop is limited.

In addition, the conventional steel prop has more components which are exposed to outer side. For example, the insertion pin 18 and the movable handle 151 of the retaining nut 15 of FIG. 1 are exposed to outer side. Also, the locking bar 29 of FIG. 3 is exposed to outer side. These exposed components tend to injure workers due to collision. Moreover, when transferring or stacking the steel props, the exposed components tend to damage due to collision.

SUMMARY OF THE INVENTION

It is therefore a primary object of the present invention to provide a steel prop which is able to bear both axial pressure and pulling force. Therefore, the application field of the steel prop is widened.

It is a further object of the present invention to provide the above steel prop which is able to bear axial bidirectional applied force. In addition, the steel prop has no components projecting toward outer side so that the possibility of injury of workers and damage of the steel prop can be minimized.

The present invention can be best understood through the following description and accompanying drawings wherein:

DETAILED DESCRIPTION OF THE PREFERRED EMBODIMENT

Figure 1:
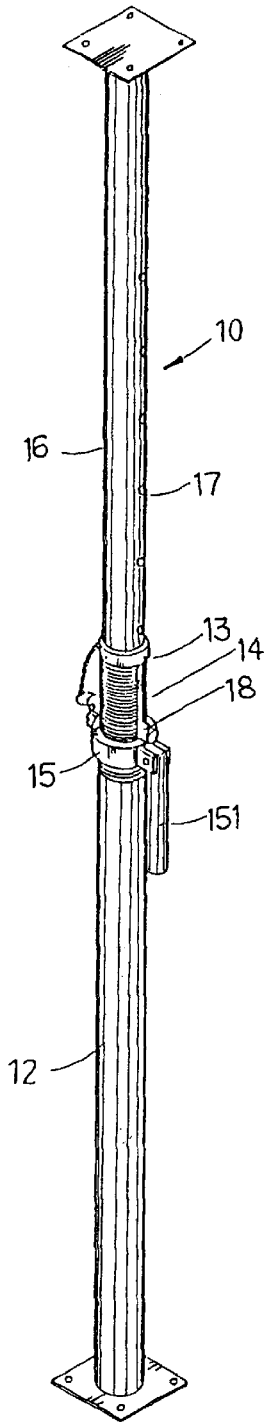
FIG.1 PRIOR ART
FIG. 1 is a perspective view of a conventional steel prop.
Figure 2:
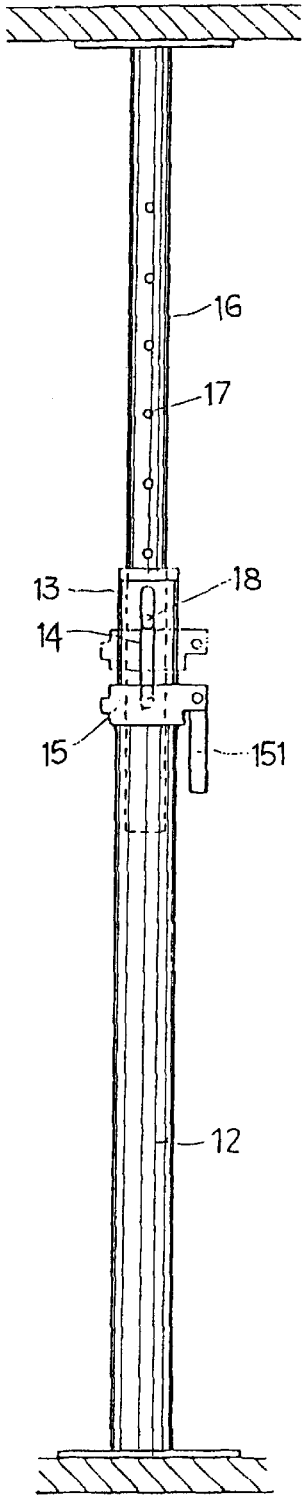
FIG.2 PRIOR ART
FIG. 2 is a front view according to FIG. 1, showing the use of the conventional steel prop.
Figure 3:
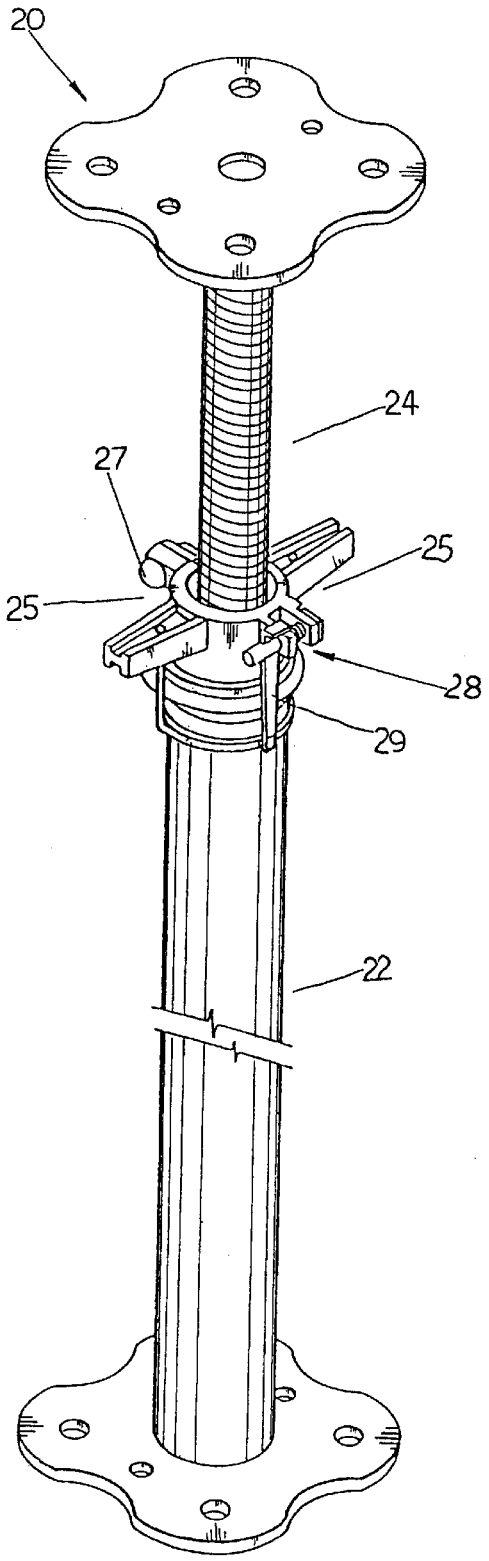
FIG.3 PRIOR ART
FIG. 3 is a perspective view of another type of conventional steel prop.
Figure 4:
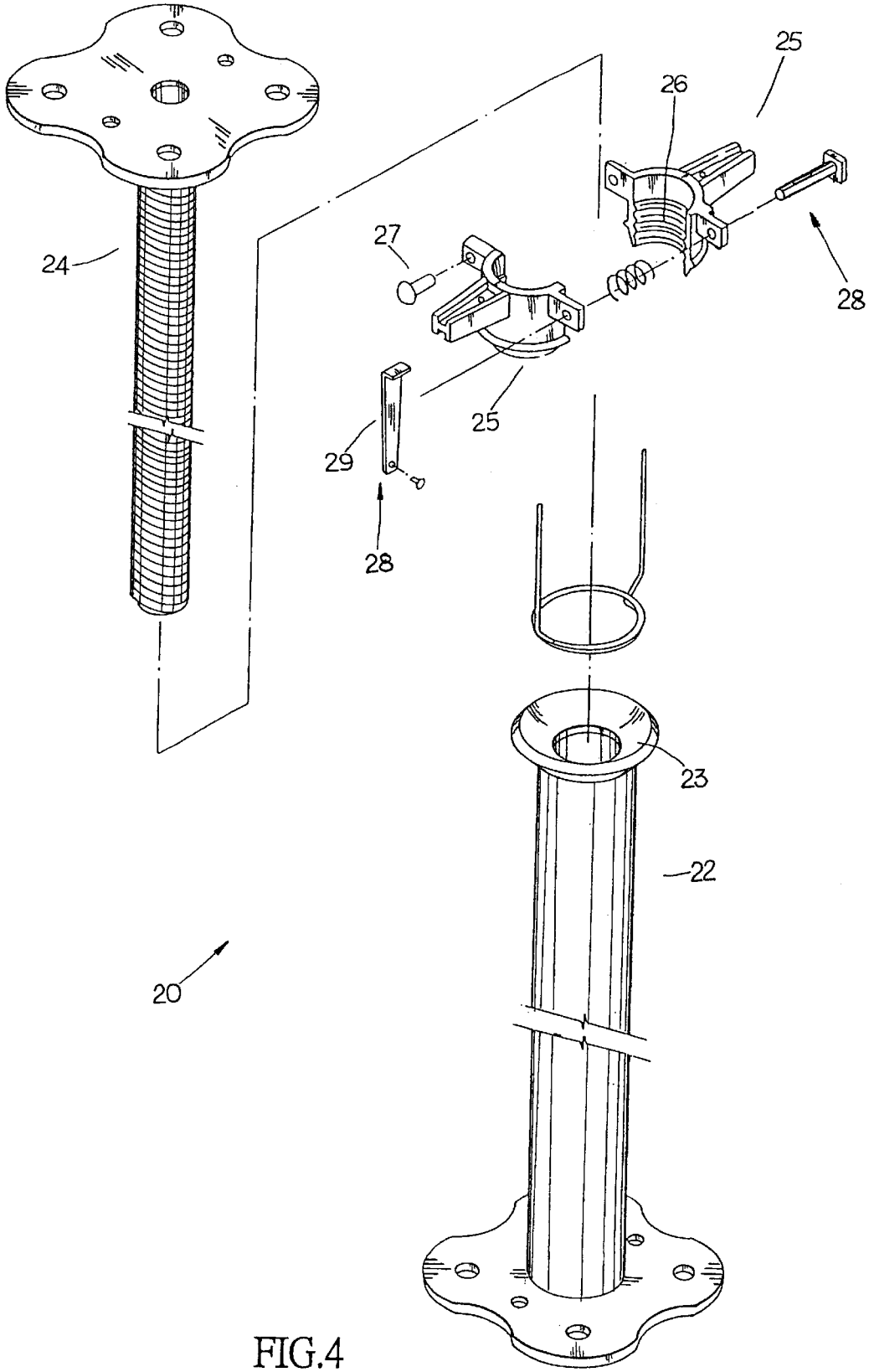
FIG.4 PRIOR ART
FIG. 4 is a perspective exploded view according to FIG. 3.
Figure 5:
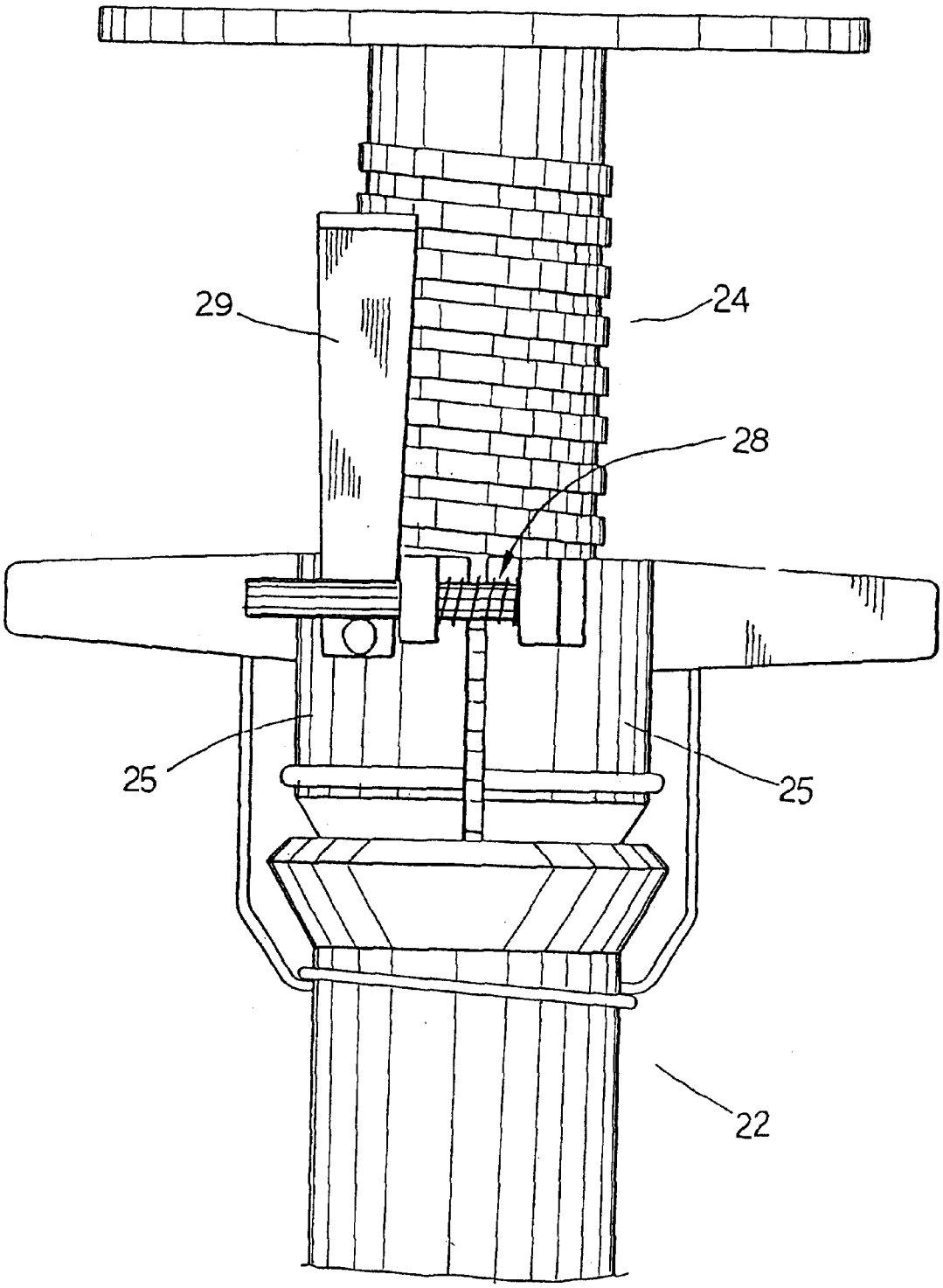
FIG.5 PRIOR ART
FIG. 5 is a front view of a part of the steel prop of FIG. 3, showing that the inner tube is not locked.
Figure 6:
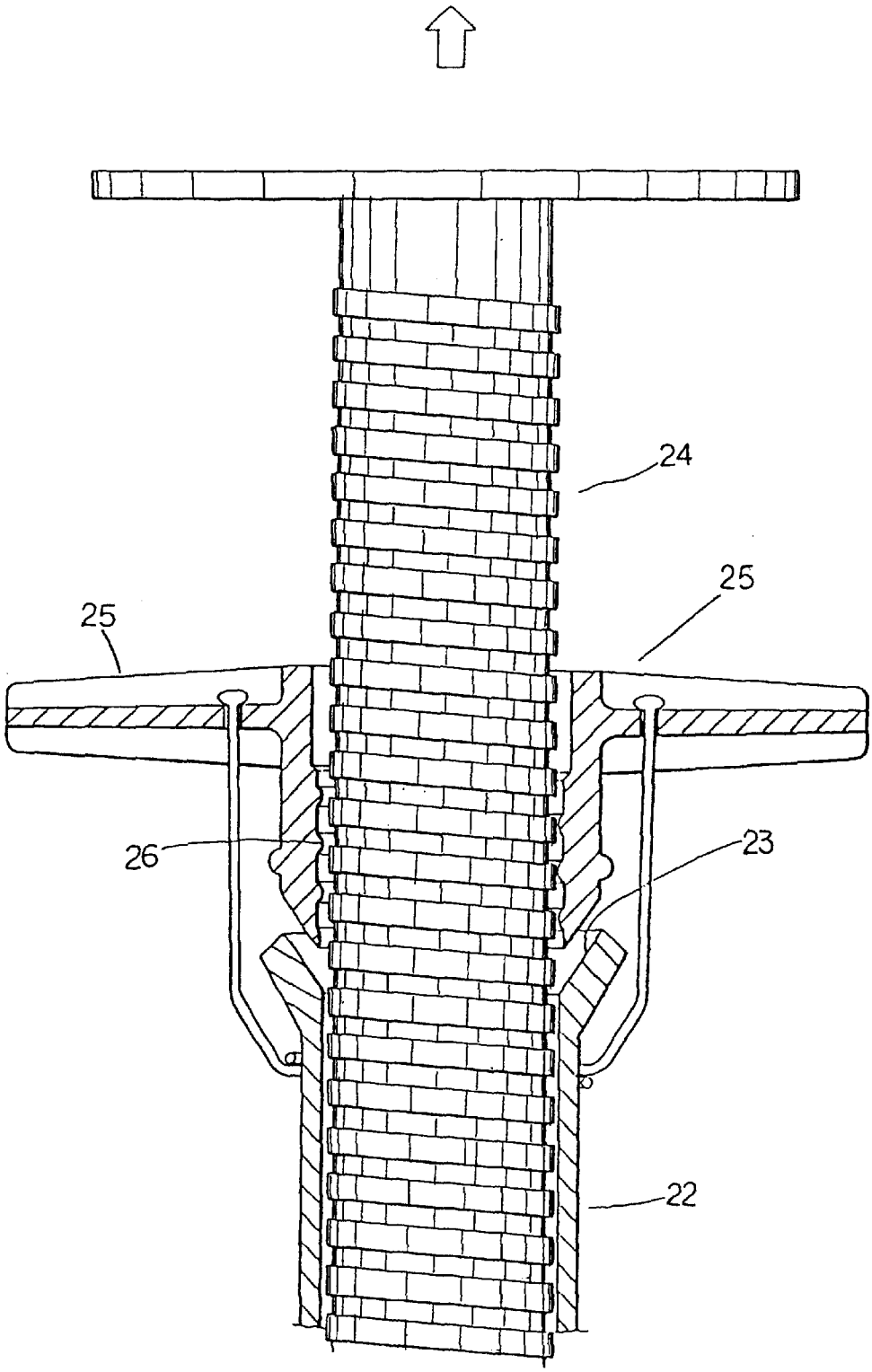
FIG.6 PRIOR ART
FIG. 6 is a longitudinal sectional view according to FIG. 5.
Figure 7:
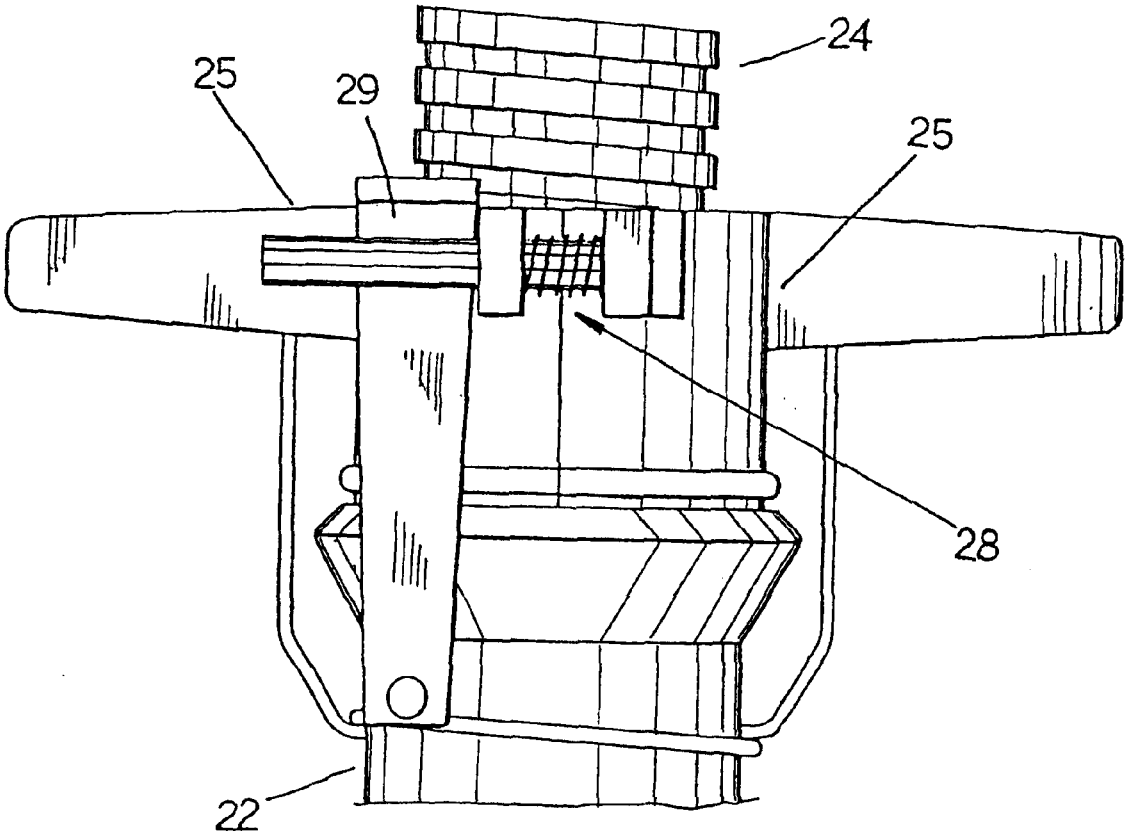
FIG.7 PRIOR ART
FIG. 7 is a view according to FIG. 5, showing that the inner tube is locked.
Figure 8:
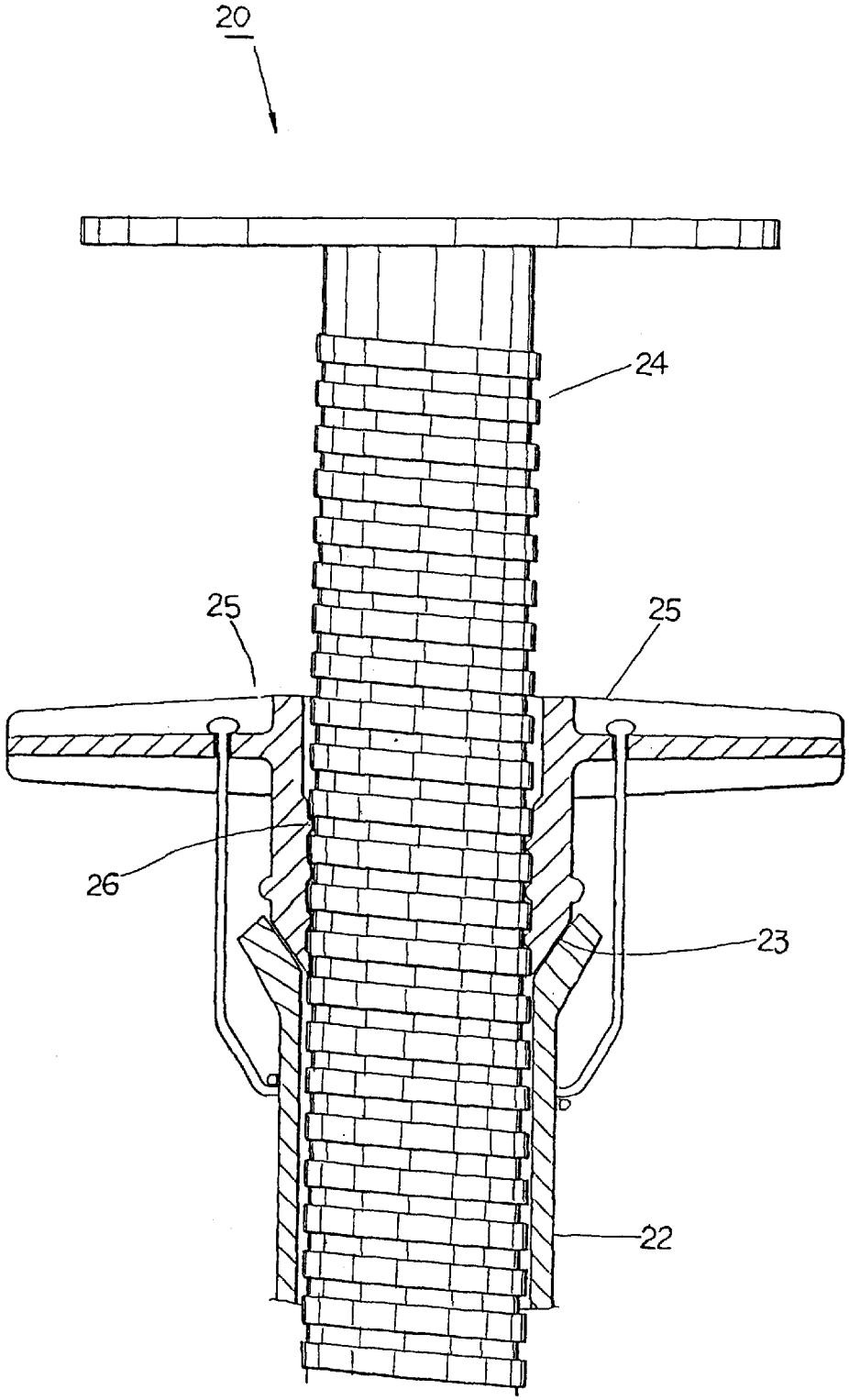
FIG.8 PRIOR ART
FIG. 8 is a longitudinal sectional view according to FIG. 7.
Figure 9:
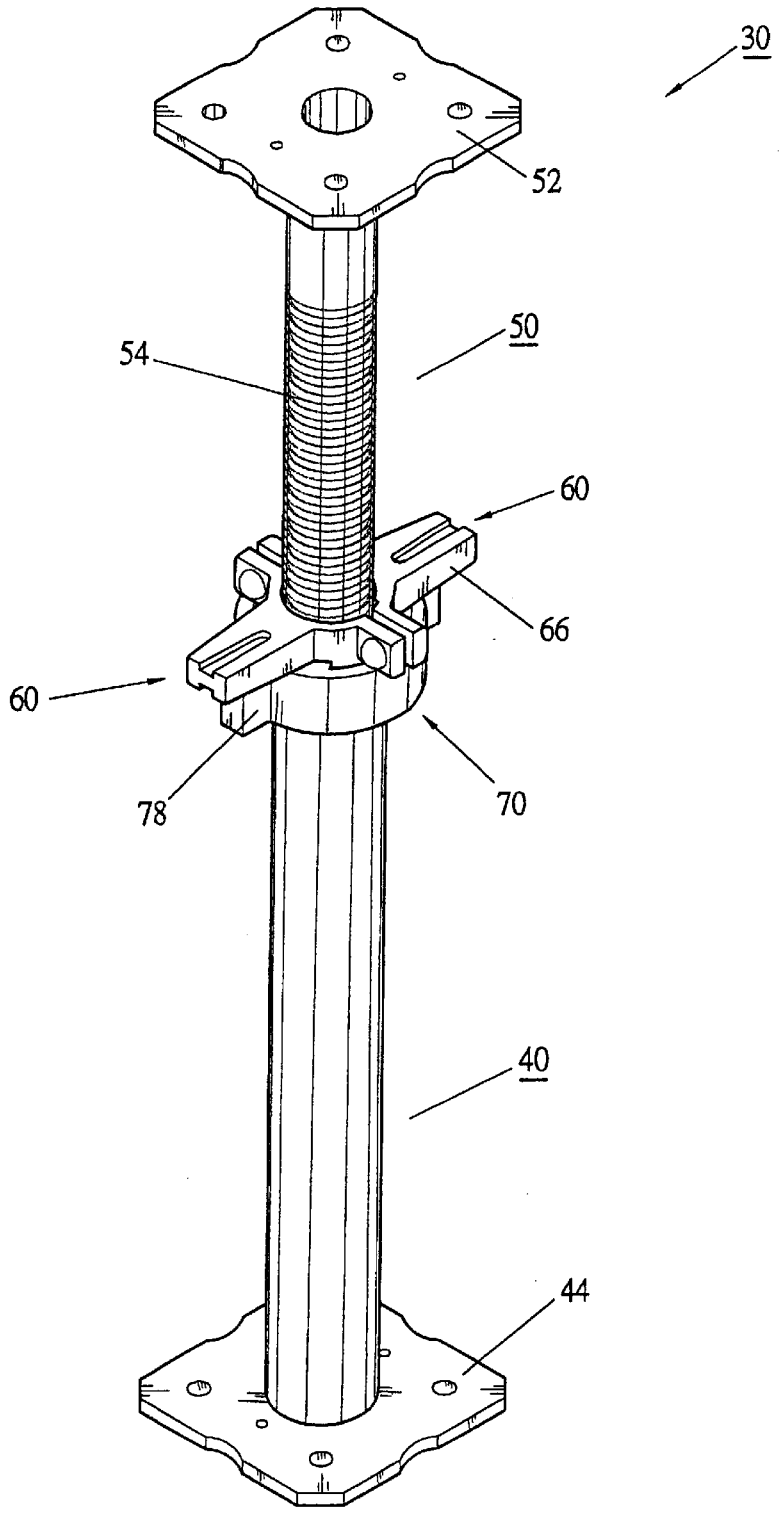
FIG. 9 is a perspective assembled view of a preferred embodiment of the steel prop of the present invention.
Figure 10:
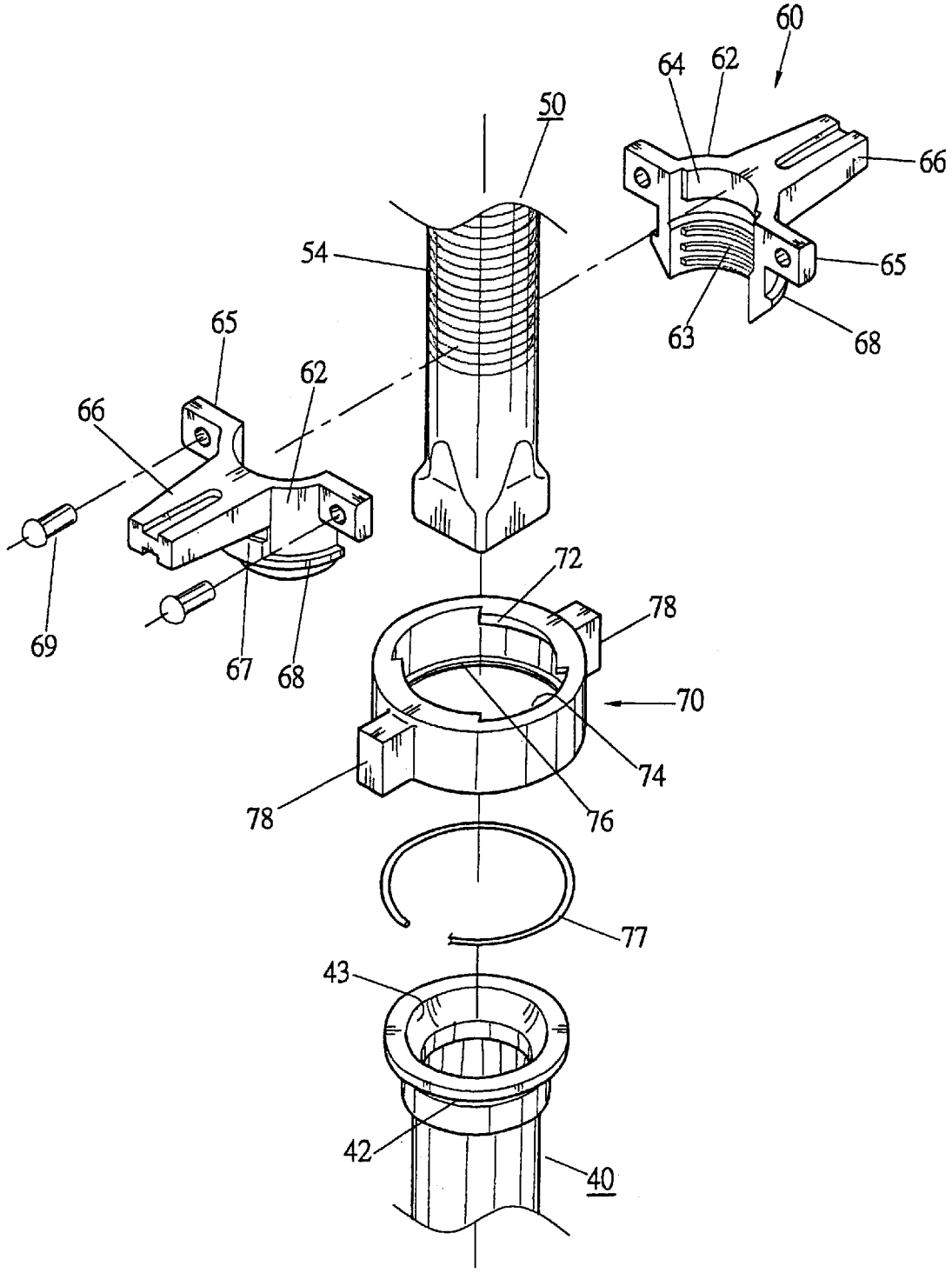
FIG. 10 is a perspective exploded view of the steel prop of the present invention.
Figure 11:
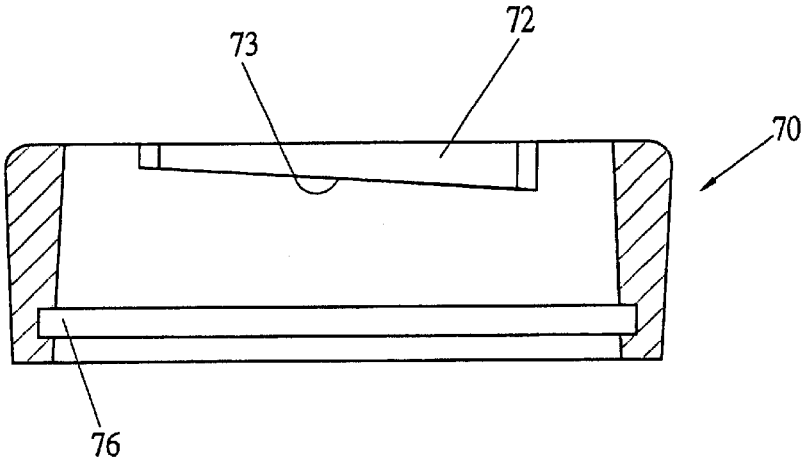
FIG. 11 is a sectional view of the retaining member of the present invention.
Figure 12:
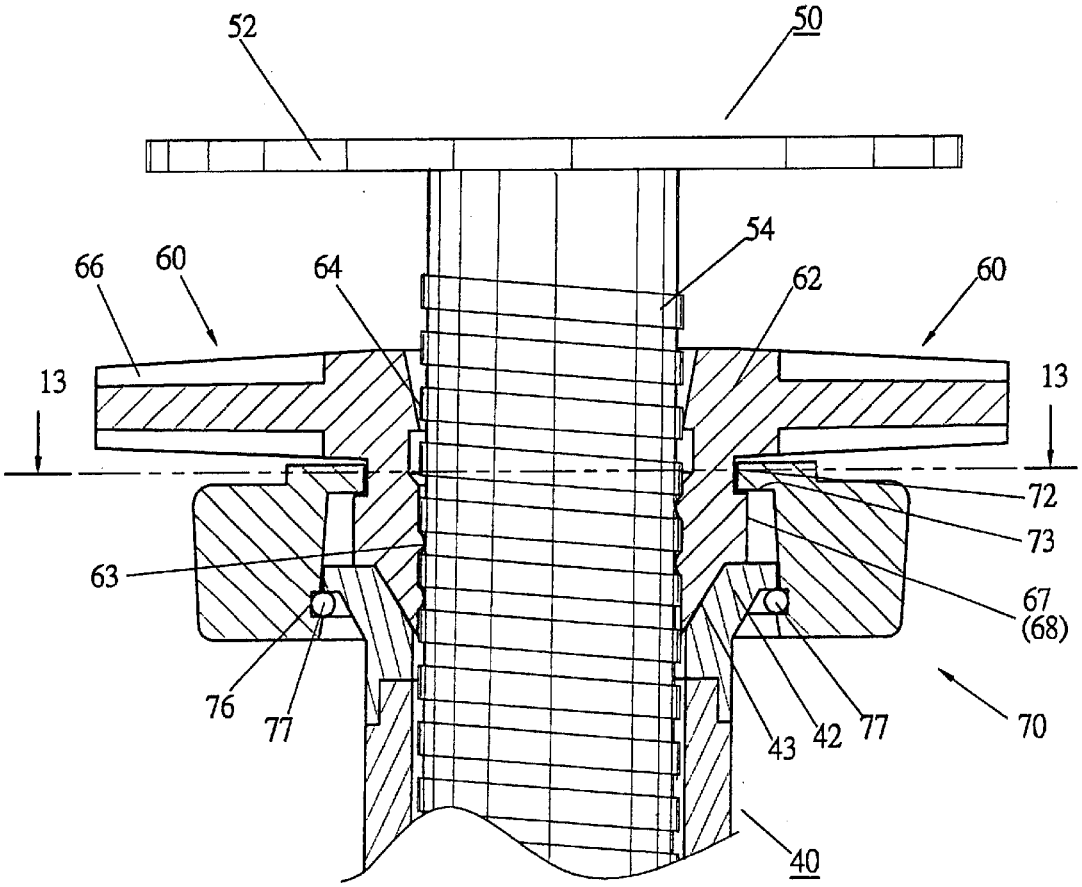
FIG. 12 is a longitudinal sectional view according to FIG. 9, showing that the inner tube is clamped.

Please refer to FIGS. 9 and 10. According to a preferred embodiment, the steel prop 30 of the present invention includes:

an outer tube 40, a top end of the outer tube 40 being formed with a flange section 42 with larger outer diameter, an inner wall of the flange section 42 being formed with a conic face 43 having inward tapered diameter, a bottom end of the outer tube 40 being provided with a bottom board section 44;

an inner tube 50, a top end of the inner tube 50 being provided with a top board section 52, the body of the inner tube 50 being formed with continuous trapezoid thread 54, the inner tube 50 being slidably nested in the body of the outer tube 40;

two clamping members 60 having identical configuration, each clamping member 60 having a body 62 with a substantially semicircular cross-section, the inner circumferential face of the body 62 being formed with several transverse thread sections 63 and a projecting section 64 above the thread sections 63, two lugs 65 being formed on two lateral sides of the body 62, a lift handle 66 outward extending from the middle of the outer circumferential face of the body 62, the body 62 being further formed with a projecting pressed section 67 under the lift handle, a semicircular rib 68 being formed on bottom edge of the body 62 along the circumference thereof under the pressed section 67, a bottom end of the body 62 being downward tapered, two pin members 69 being respectively passed through the lugs 65 of the clamping members 60 to connect and mate the clamping members with each other without departure, a clearance being defined between the clamping members, whereby the clamping members can be moved toward or away from each other within a limited distance, the two clamping members 60 being positioned on the conic face 43 of the outer tube 40; and a retaining member 70 which is a hollow ring body encompassing the clamping members 60. The inner circumference of top edge of the retaining member 70 is formed with two inward projecting engaging lips 72 at equal intervals, the two engaging lips 72 define therebetween two recesses 74. The thickness of the engaging lip 72 is tapered so that the bottom face thereof is formed with an inclined pressing face 73 as shown in FIG. 11. The bottom edge of inner circumference of the retaining member is further formed with an annular groove 76. A stop member 77 such as a C-ring is inlaid in the annular groove 76 to form a stop section. The outer circumference of the retaining member is formed with two drive sections 78 at equal intervals. The retaining member 70 is rotatably fitted around the top of the outer tube 40 with the stop member 77 engaged with outer face of the flange section 42 without departing from the outer tube as shown in FIG. 12. The lower halves of the bodies 62 of the clamping members 60 are received in the retaining member 70. The pressed sections 67 and the ribs 68 are positioned under the engaging lips 72. The lift handles 66 are exposed to outer side for manual operation.

When assembled, the retaining member 70 is fitted onto the outer tube and the two clamping members 60 are installed in the retaining member 70 and then the inner tube 50 is nested into the outer tube 40.

Figure 13:
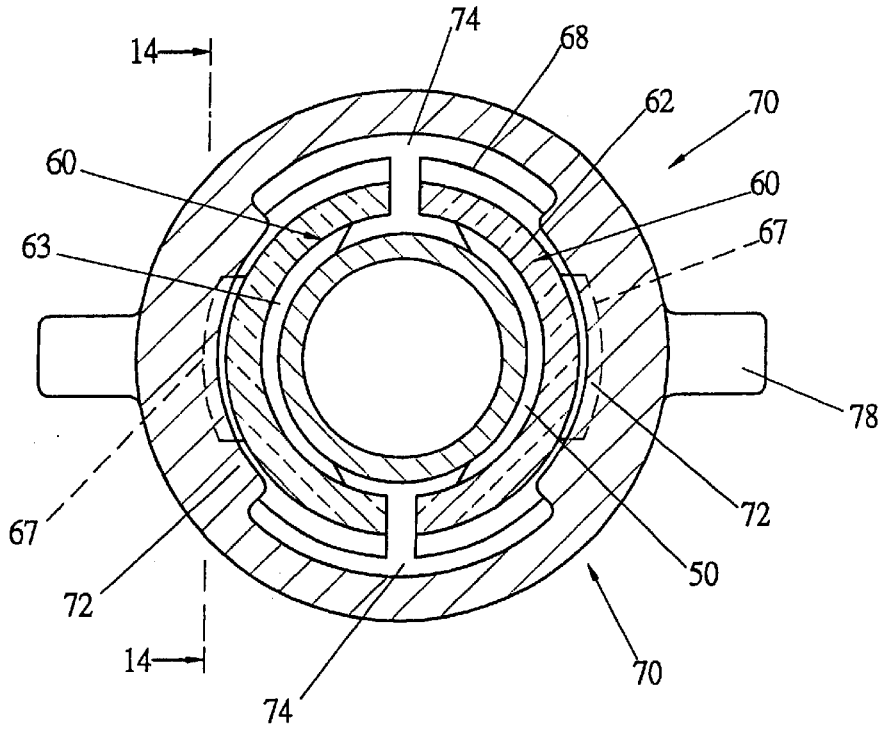
FIG. 13 is a sectional view taken along line 13—13 of FIG. 12.
Figure 14:
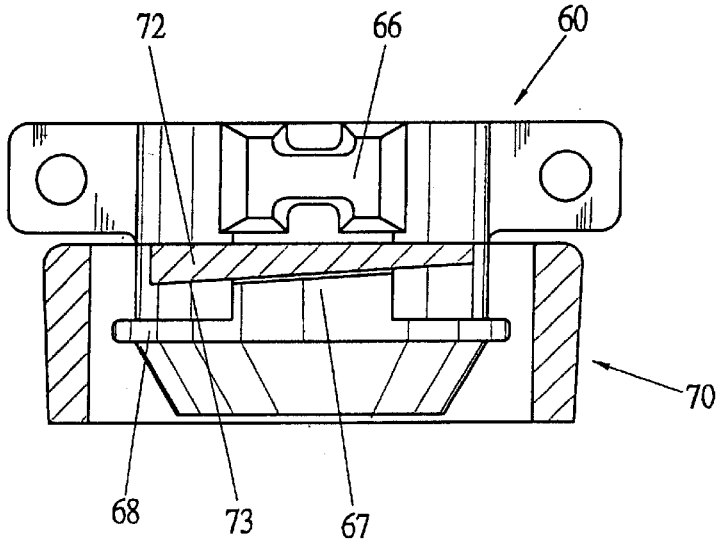
FIG. 14 is a sectional view taken along line 14—14 of FIG. 13.

FIG. 12 shows the steel prop 30 in a locked state. At this moment, the pressing faces 73 of the engaging lips 72 of the retaining member 70 press the pressed sections 67 of the clamping members 60 as shown in FIGS. 13 and 14. The clamping members 60 are guided by the conic face 43 to inward move toward each other. The thread sections 63 mesh with the thread 54 of the inner tube 50 so as to tightly clamp the inner tube. Under such circumstance, the inner tube is prevented from retracting into the outer tube. Also, the stop member 77 of the retaining member 70 is engaged with the outer face of the flange section 42 of the outer tube 40 and prevented from being moved upward. Accordingly, the clamping members 60 and the inner tube 50 are stopped by the retaining member 70 from being extracted from the outer tube. In FIG. 12, the components are tightly engaged with each other and the inner tube can neither be retracted into the outer tube nor be pulled out of the outer tube.

Figure 15:
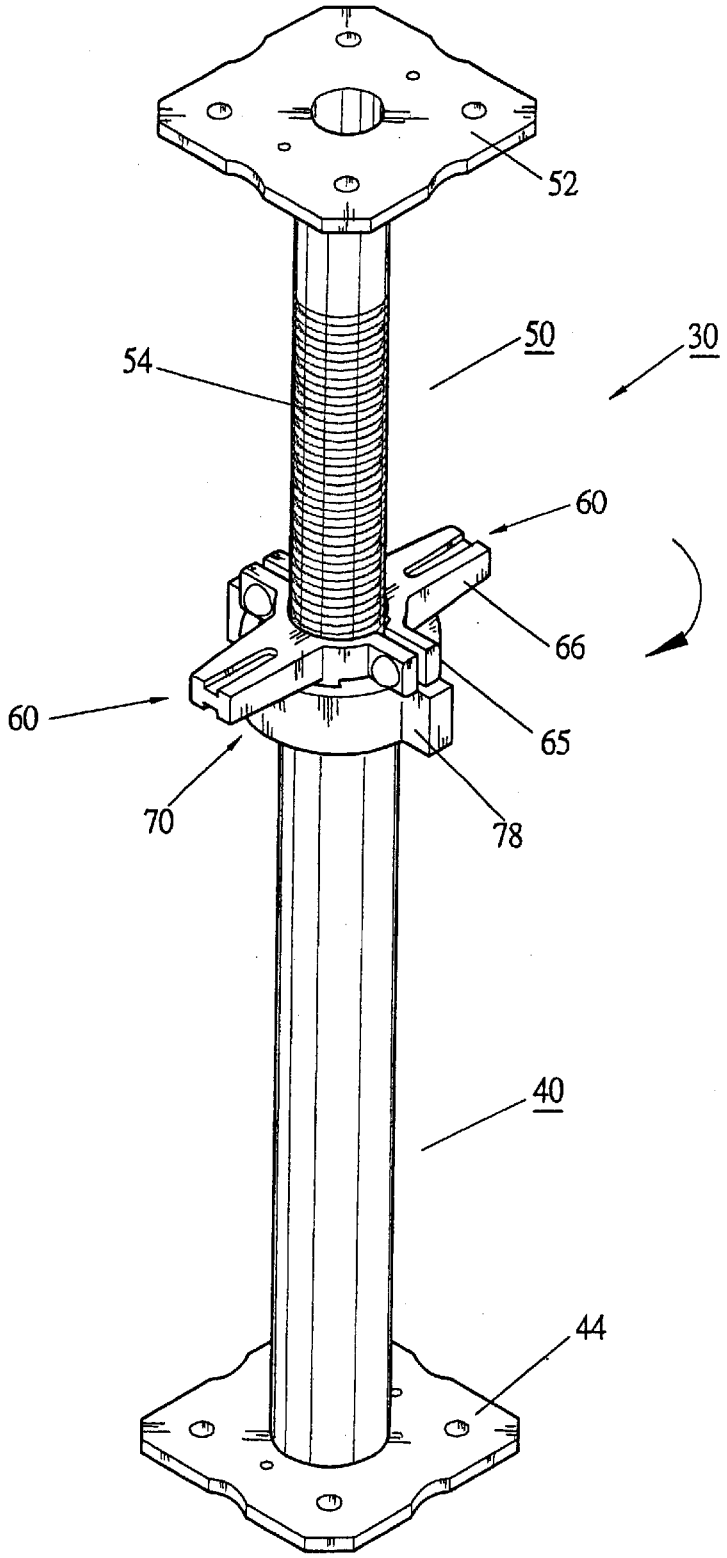
FIG. 15 is a view according to FIG. 9, showing that the inner tube is released from clamping.
Figure 16:
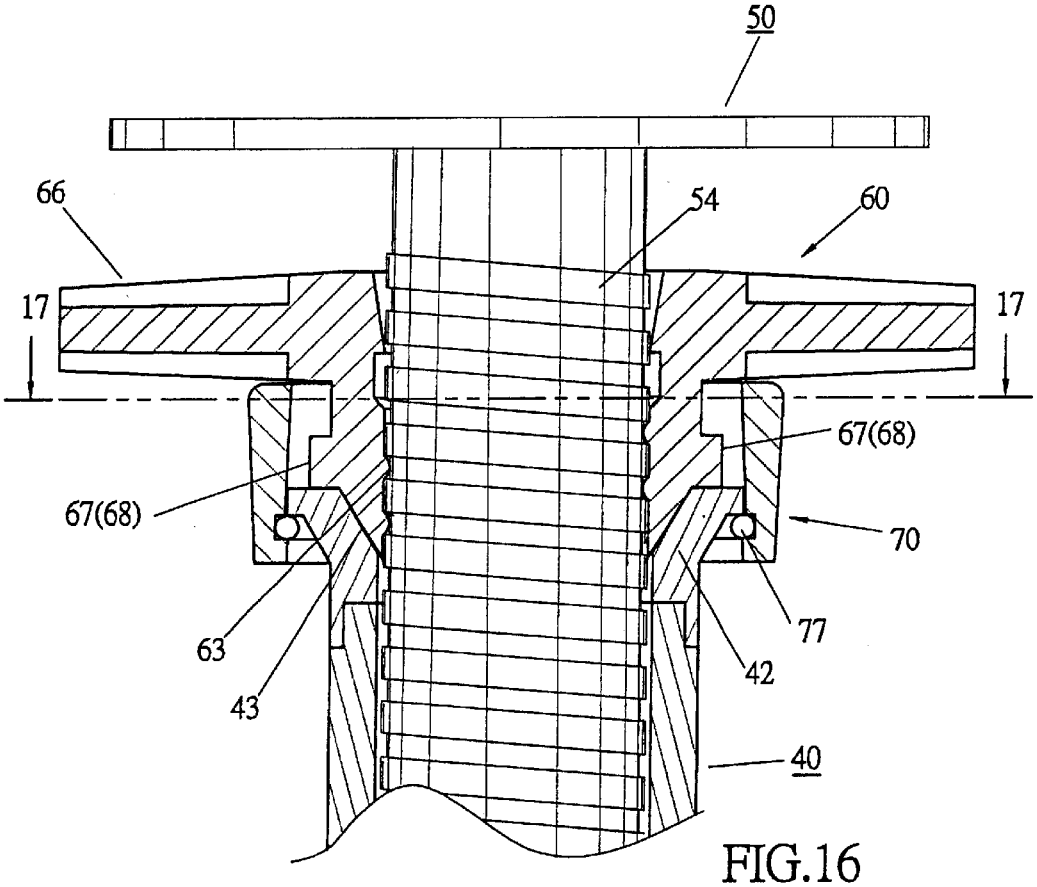
FIG. 16 is a longitudinal sectional view according to FIG. 15.
Figure 17:
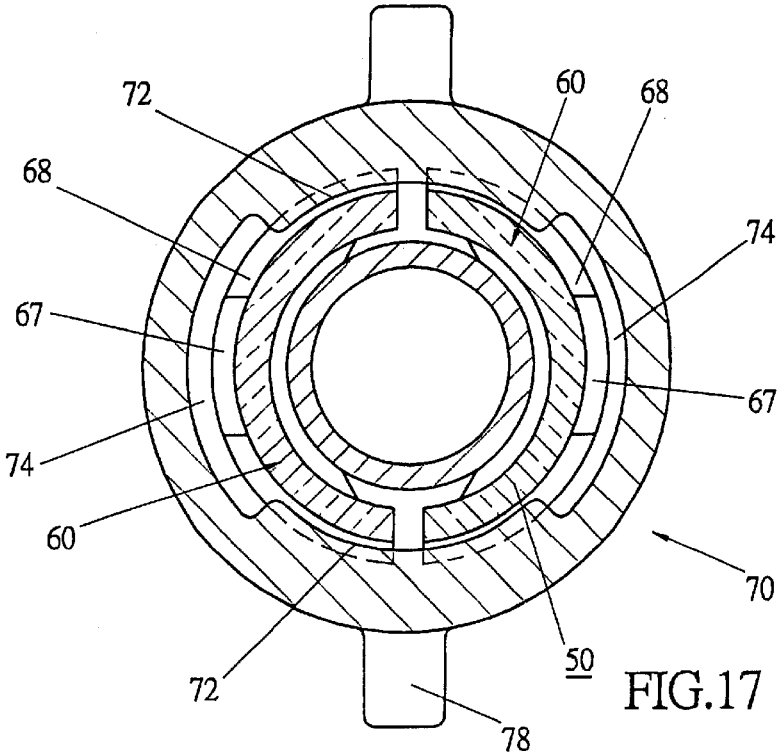
FIG. 17 is a sectional view taken along line 17—17 of FIG. 16.
Figure 18:
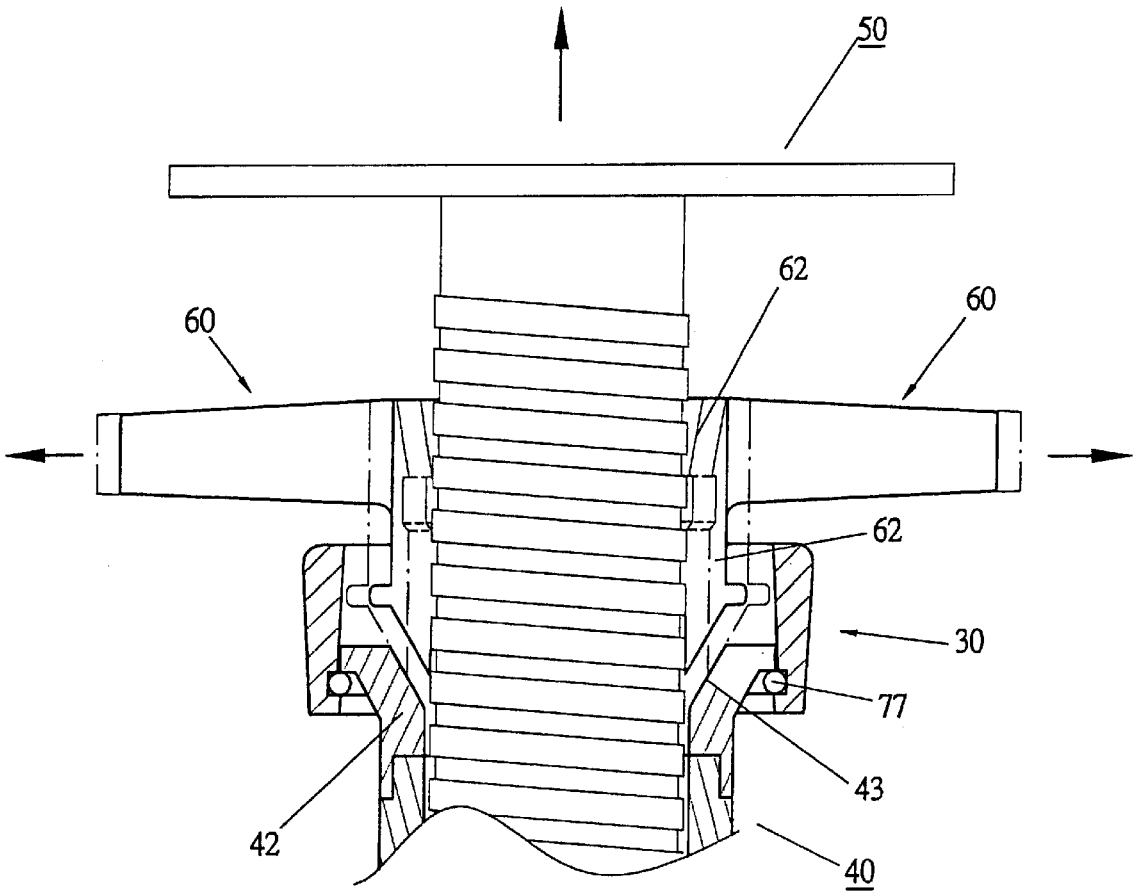
FIG. 18 is a view according to FIG. 16, showing that the inner tube is pulled out.

When adjusting the projecting length of the inner tube 50 from the outer tube 40, first, the retaining member 70 is clockwise rotated by 90 degrees in a direction as shown in FIG. 15. In operation, a tool is first used to knock the drive section 78 of the retaining member to loosen the retaining member. At this time, the pressed sections 67 of the clamping members 60 are aligned with the recesses 74 of the retaining member and free from pressing force of the engaging lips 72 as shown in FIGS. 16 and 17. Therefore, the clamping members are released from the pressing force of the retaining member. Then, an operator can hold the inner tube 50 with one hand to upward pull out the inner tube as shown in FIG. 18. The inner tube 50 can be stretched to a necessary height with the top board section 52 thereof abutting against a moldboard of a beam or a floor. When beginning to upward move the inner tube 50, the two clamping members 60 mesh with the inner tube 50 so that the clamping members will be upward moved along with the inner tube 50. After the bottom ends of the claming members leave the conic face 43, the clamping members 60 can freely expand as shown by the phantom line of FIG. 18. At this time, the thread sections 63 of the clamping members no more mesh with the thread 54 of the inner tube 50, permitting the inner tube to be successfully pulled out.

Accordingly, when beginning to upward move the inner tube 50, the clamping members 60 still mesh with the inner tube 50 so that the clamping members will be upward moved along with the inner tube 50 by a certain distance. As shown in FIG. 17, the pressed sections 67 of the clamping members 60 are aligned with the recesses 74 of the retaining member 70 without being obstructed, so that the clamping members can be freely moved upward. The ribs 68 of the clamping members are still stopped by the engaging lips 72 so that the clamping members are prevented from detaching out of the retaining member.

After the inner tube 50 is moved to a desired height and released from the pulling force, the inner tube 50 tends to slip down due to gravity. However, the clamping members 60 falling onto the conic face 43 are guided thereby to get closer to each other. At this time, the thread sections 63 will mesh with the thread 54 of the inner tube 50. Accordingly, after the inner tube 50 is released from the pulling force, the inner tube is immediately fixedly clamped by the clamping members and located at the desired height.

When the steel prop is used to support a moldboard, an operator can quickly upward moves the top board section 52 of the inner tube 50 to the moldboard. However, due to pitch of the thread 54 of the inner tube, generally the top end of the inner tube will be still spaced from the moldboard by a minor distance. Under such circumstance, the operator can hold the lift handles 66 with both hands to counterclockwise rotate the clamping members 60 about the top end of the outer tube 40. By means of engagement between the thread sections 63 of the clamping members and the thread 54 of the inner tube 50, the inner tube 50 is moved upward to eliminate the minor gap. Accordingly, the top board section 44 and bottom board section 52 of the steel prop 30 can truly retain the floor or moldboard. Then, the retaining member 70 is counterclockwise rotated by 90 degrees and restored to the state as shown in FIGS. 9 and 12 to 14. The pressing faces 73 of the engaging lips 72 of the retaining member tightly press down the two clamping members 60, whereby the clamping members are again guided by the conic face 43 to mate with each other so as to tightly clamp the inner tube 50. At the same time, due to the slope of the pressing face 73, the retaining member 70 is moved upward to make the stop member 77 tightly abut against the outer face of the flange section 42 as shown in FIG. 12. Accordingly, the components 40, 50, 60 and 70 are tightly engaged with each other to prevent the inner tube 50 from retracting into the outer tube 40 or slipping out from the outer tube. A tool can be used to knock the drive section 78 of the retaining member for tightening the same.

Figure 19:
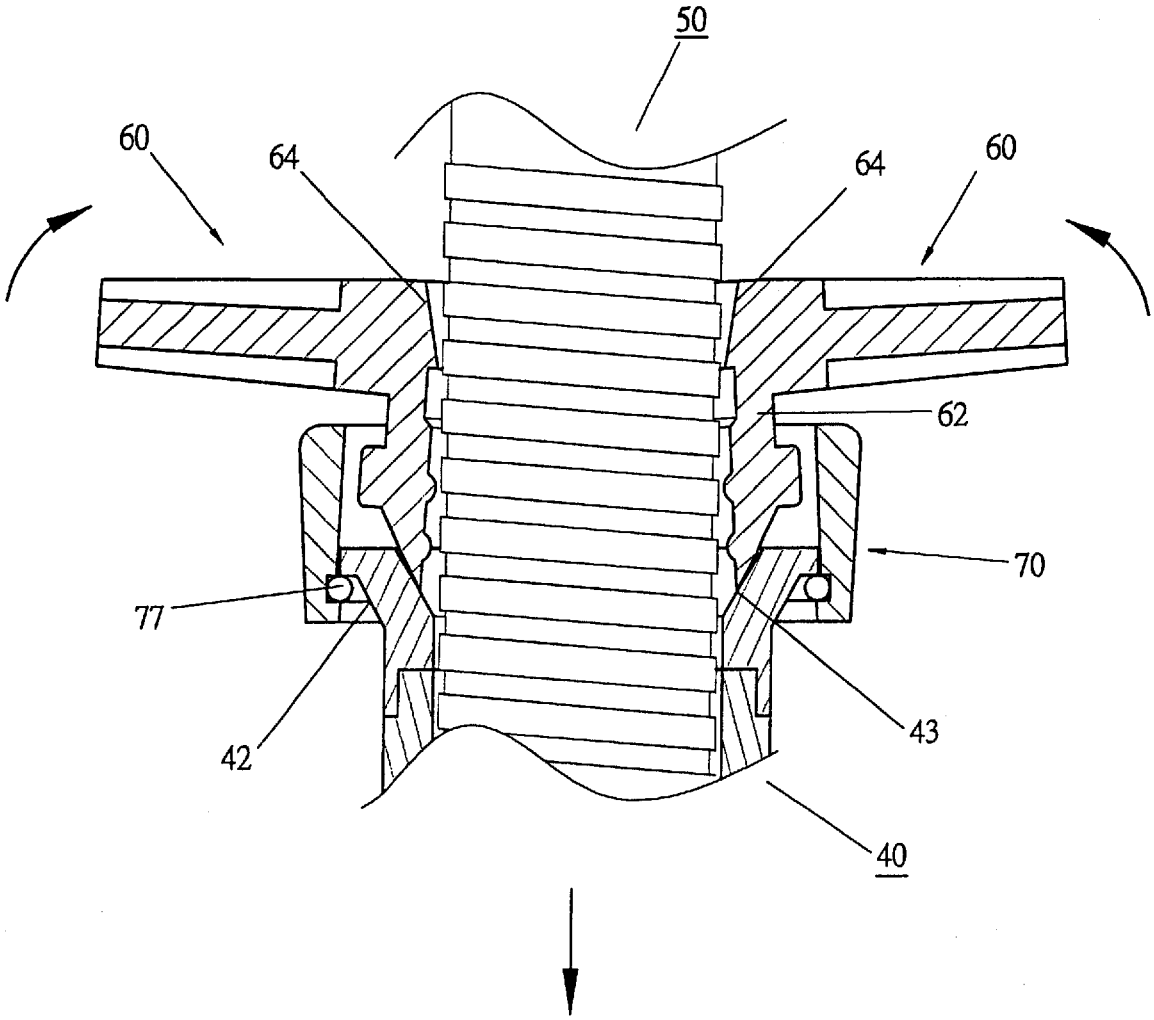
FIG. 19 is a sectional view showing that the inner tube is nested into the outer tube.

When telescoping the steel prop 30, first, as shown in FIG. 15, the retaining member is disengaged from the clamping members. Then, the operator holds the lift handles 66 with both hands to clockwise rotate the two clamping members 60 so as to lower the top end of the inner tube 50. After the top end leaves the moldboard by a minor distance, the two lift handles 66 are upward pushed as shown in FIG. 19. As referring to FIG. 17, the pressed sections 67 of the clamping members are free from the obstruction of the engaging lips 72 so that the operator can upward push the clamping members. After the clamping members are separated from the conic face 43, the clamping members are free from the restriction of the conic face and can be expanded. At this time, the inner tube 50 is no more clamped by the clamping members 60 and will drop down due to gravity to be nested into the outer tube 40. When the operator lifts the clamping members, the ribs 68 thereof are still stopped by the engaging lips 72 of the retaining member without detaching therefrom.

In addition, in the state of FIG. 19, when lifting the clamping members 60 to drop down the inner tube 50, the outer circumference of the inner tube abrades against the projecting sections 64 of the clamping members so that the thread sections 63 are protected from being damaged due to sliding friction between the inner tube and the clamping members.

Furthermore, in engaged state, the drive sections 78 of the retaining member 70 are aligned with the lift handles 66 of the clamping members 60. In released state, the drive sections 78 are aligned with the lugs 65 of the clamping members. Therefore, it can be easily judged from appearance whether the steel prop is locked or released.

Figure 20:
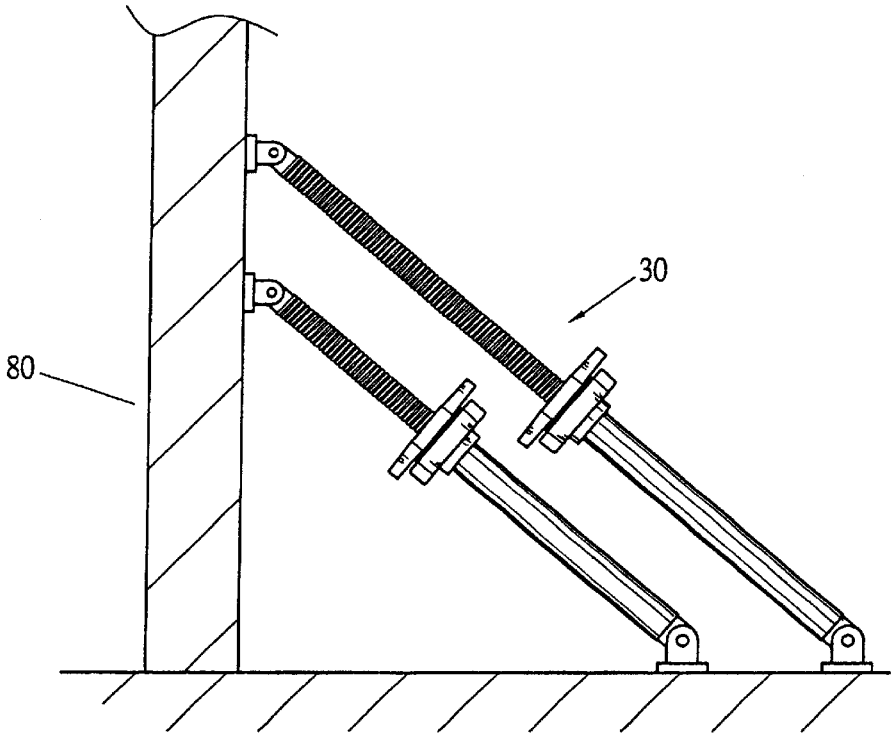
FIG. 20 shows that the steel prop of the present invention is used to support moldboards in an inclined state.
Figure 21:
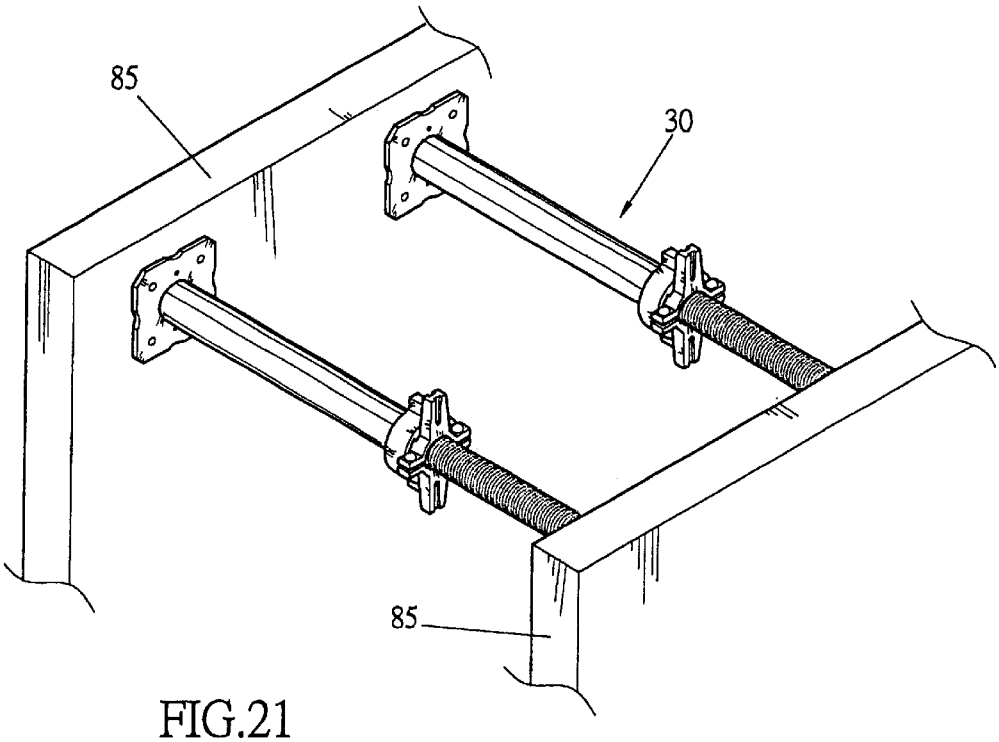
FIG. 21 shows that the steel prop of the present invention is used to support moldboards in a horizontal state.

The steel prop of the present invention is able to bear bidirectional axial force. Therefore, the steel prop can be positioned upright to support moldboards. Alternatively, as shown in FIG. 20, one end of the steel prop 30 can be fixed on the ground, while the other end thereof is fixed on an upright wall face or moldboard 80 to create a diagonal supporting effect. Accordingly, the steel prop can bear axial pulling force and pressure to prevent the wall face or moldboard 80 from tilting down. Alternatively, as shown in FIG. 21, the steel prop can horizontally support upright moldboards 85 to prevent the same from tilting down prior to grouting.

The present invention has the following advantages:

1. The steel prop of the present invention is able to bear bidirectional axial force. Therefore, the steel prop can not only bear axial pressure to support moldboards, but also can bear axial pulling force pressure to create a diagonal supporting effect for inclinedly or horizontally supporting moldboards. Therefore, the application field of the steel prop is widened.
2. The steel prop has no movable component exposed to outer side. Therefore, in working site, workers are protected from being injured due to collision. When transferred or stacked, the components are prevented from being damaged due to collision so that the using life of the steel prop is prolonged.

The above embodiment is only used to illustrate the present invention, not intended to limit the scope thereof.

What is claimed is:

1. Steel prop capable of bearing bidirectional applied force, comprising:

an outer tube, inner wall of top end of the outer tube being formed with a conic face having inward tapered inner diameter;

an inner tube, the body of the inner tube being formed with continuous thread, a bottom end of the inner tube being back and forth slidably nested in the outer tube;

two clamping members each having a body, an inner circumferential face of the body being semicircular and formed with several transverse thread sections, a lift handle being disposed on outer circumferential face of the body of each clamping member, a projecting pressed section having a certain width being formed under the lift handle, two lateral sides of the clamping members being connected, whereby the clamping members can be moved toward or away from each other within a certain distance without departure; and a retaining member, having two inward projecting engaging lips spaced apart at equal intervals on a section through an inner circumference at a top of the retaining member creating two equal recesses between the engaging lips on the section through the inner circumferences, a bottom face of the engaging lips being formed with a sloped pressing face, the retaining member being rotatably fitted around top end of the outer tube, a bottom edge of the retaining member being stopped by the top end of the outer tube, so that the retaining member is prevented from departing from the top end of the outer tube, lower halves of the bodies of the clamping members being received in the retaining member, in normal state, the bottom ends of the clamping members being positioned on the conic face and the pressed sections being positioned under the engaging lips of the retaining member, the lift handles being positioned outside the retaining member for manual operation, wherein when rotating the retaining member in a first direction, the sloped pressing faces of the engaging lips press against the pressed sections of the clamping members and tightly engage the retaining member to the clamping members, wherein the two clamping members are guided by the conic face to mate with each other and the thread sections of the clamping members mesh with the thread of the inner tube, the bottom edge of the retaining member being upward engaged with the top end of the outer tube, wherein when rotating the retaining member in a second direction, the engaging lips are disengaged from the pressed sections, and the pressed sections are aligned with the recesses and the clamping members are disengaged from the retaining member to release the inner tube from the clamping members, wherein when the clamping members are engaged by the retaining member, the steel prop is able to bear both axial pressure and axial pulling force.

2. Steel prop as claimed in claim 1, wherein the top end of the outer tube is formed with a flange section with larger outer diameter and the bottom edge of inner circumference of the retaining member is provided with a stop section stopped by the flange section.

3. Steel prop as claimed in claim 2, wherein the bottom edge of inner circumference of the retaining member is formed with an annular groove and a stop member is inlaid in the annular groove to form the stop section.

4. Steel prop as claimed in claim 1, wherein a transverse rib with a certain length is formed on outer circumference of the body of each clamping member under the pressed section, the rib being stopped by the engaging lip of the retaining member.

5. Steel prop as claimed in claim 1, wherein two lugs are formed on two lateral sides of each clamping member and two pin members are respectively passed through the lugs of the clamping members to such connect the clamping members that the clamping members can be moved toward or away from each other within a certain limited distance.

6. Steel prop as claimed in claim 1, wherein a certain number of projecting drive sections are disposed on outer circumference of the retaining member.

7. Steel prop as claimed in claim 1, wherein the pressing face is an inclined face.

8. Steel prop as claimed in claim 1, wherein the top face of the pressed section is an inclined face.

* * * * *